United States Patent [19]

Suzuki et al.

[11] Patent Number: 4,665,957

[45] Date of Patent: May 19, 1987

[54] LIQUID FILLING DEVICE

[75] Inventors: Toshio Suzuki; Takeshi Saegusa; Toshimitsu Takasu; Yuji Nakayama; Yutaka Yamaguchi, all of Yokohama, Japan

[73] Assignee: Kirin Beer Kabushiki Kaisha, Tokyo, Japan

[21] Appl. No.: 795,670

[22] PCT Filed: Feb. 22, 1985

[86] PCT No.: PCT/JP85/00080

§ 371 Date: Oct. 17, 1985

§ 102(e) Date: Oct. 17, 1985

[87] PCT Pub. No.: WO85/03693

PCT Pub. Date: Aug. 29, 1985

[30] Foreign Application Priority Data

Feb. 24, 1984 [JP] Japan ..... 59-33790

[51] Int. Cl.[4] ..... B67C 3/32

[52] U.S. Cl. ..... 141/39; 141/303

[58] Field of Search ..... 141/37–70, 141/285–310, 1–12

[56] References Cited

U.S. PATENT DOCUMENTS 4,206,789 6/1980 Jordan et al. ..... 161/303

*Primary Examiner*—Houston S. Bell, Jr.

*Attorney, Agent, or Firm*—Stevens, Davis, Miller & Mosher

[57] ABSTRACT

A counterpressure liquid filling device for a container (1) comprises a gas discharge passage (9*a*) for discharging the pressurized gas of the container (1) into the atmosphere, the gas discharge passage (9*a*) being branched into a first branch discharge conduit (12), one end of which is communicated with the neck of the container (1), and a second branch discharge passage (13), one end of which is communicated with the container at a position where the quantity of the liquid to be filled is determined, the other ends of both the first branch discharge conduit (12) and the second branch discharge passage (13) being communicated with a valve operating chamber (11). A gas flow control valve (10) is housed in the valve operating chamber (11). The first branch discharge conduit (12) and the second branch discharge conduit (13) are in communication with mutually opposite sides of the gas flow control valve (10), while the liquid is being filled, but, when the liquid surface has reached the position of quantity determination, the gas flow control valve seals the gas discharge passage (9*a*). Thus it is possible not only to block the entry of the liquid into the second branch discharge conduit (13), but also to fill the container (1) with the precisely selected quantity of the liquid.

4 Claims, 2 Drawing Figures

LIQUID FILLING DEVICE

TECHNICAL FIELD

The present invention relates to a liquid filling device for use in filling beverages such as beer and other carbonated beverages or refreshments.

BACKGROUND OF THE INVENTION

In the prior art, generally speaking, in order to fill beer or other carbonated beverage into a bottle, it has been the custom to fill the liquid via a filling tube into the bottle while the bottle interior is held under an elevated pressure. The filling operation is automatically terminated when a specified quantity of the liquid has been filled. As a filling device for use in the above-described filling operation, that of Fed. Rep. of Germany Patent No. 22341204 (corresponding to Japanese Patent Publication No. 10063/77) is publicly known.

In such a prior art counterpressure liquid filling machine, the liquid supply is automatically stopped when the pressure within the container is caused to rise as a result of the closure of a pressure gas discharge tube with a ball valve. The pressure gas discharge tube is provided through the container opening into the inside of the container and terminating at a selected depth from the opening. The ball valve is provided at a position within the container. When the bottom opening of the gas discharge tube is closed or sealed by an elevating liquid surface, the gas pressure inside the gas discharge tube increases, thus raising and actuating the ball valve to close the passage of the discharge tube.

However, in the aforementioned prior art counterpressure liquid filling machine, in which automatic measurement of the liquid is achieved by means of a ball valve which moves upward with the elevation of the liquid surface level within the discharge tube, since the tube has a bottom end at a certain distance or depth below the container opening, it is necessary, after completing the filling operation, to blow out or blast residual liquid remaining in the discharge passage to prepare for the next filling. As a result of the blowout, a blow mist is generated, which leads to problems connected with control of micro-organisms and to loss or waste of the filling liquid.

It is, therefore, an object of the current invention to obviate and remove the above-described difficulties associated with the filling operation of such liquids as beer and other refreshments: to eliminate the necessity of blowout or blast so as to cause no problems connected with control of the micro-organisms and to prevent loss or waste of filling liquid, while precisely keeping filling of the predetermined amount of liquid.

DISCLOSURE OF THE INVENTION

According to the present invention, in a liquid filling device having a filling tube for filling a liquid into a container, a pressurized gas supply conduit for introducing gas under elevated pressure into the container, and a gas discharge conduit for conducting pressurized gas from the interior of the container into the open air as the liquid surface moves upward, there are provided in connection with the gas discharge conduit a first branch discharge conduit and a second branch discharge passage, the first branch discharge conduit having a bottom end opening at the uppermost end of the container or bottle neck, and the second branch discharge passage having a bottom end opening at a position below the bottom end of the first branch discharge conduit, at which second position a selected quantity of liquid to be filled is determined. The top end openings of both the first branch discharge conduit and the second branch discharge passage are in communication with a valve operating chamber in which a gas flow control valve is housed loosely. Before the selected quantity of the liquid is introduced into the container, the top end openings of the first branch discharge conduit and the second branch discharge passage are respectively in communication with the opposite sides with respect to the gas flow control valve. When the container has been filled with the predetermined quantity of the liquid, the bottom end opening of the second branch discharge passage is sealed by the liquid, whereby the pressurized gas in the first branch discharge conduit moves the gas flow control valve upward, and a result, seals the entire discharge passage and permits no exit.

Therefore, as is apparent from the foregoing, in accordance with the counterpressure liquid filling device according to the present invention, it is possible to eliminate the blast or blowout process entirely, and since the gas flow control valve is operated by the pressure differential, the filling device can be applied to conventional instruments without difficulty. The device of the invention is also effective in connection with control over microorganisms and is essentially useful for eliminating loss or waste of the filling liquid, while assuring precise filling of the selected quantity of liquid into the bottle or container.

BEST MODE FOR PRACTICING THE INVENTION

Referring now to the figures, one embodiment of the current invention will be described.

Figure 1:
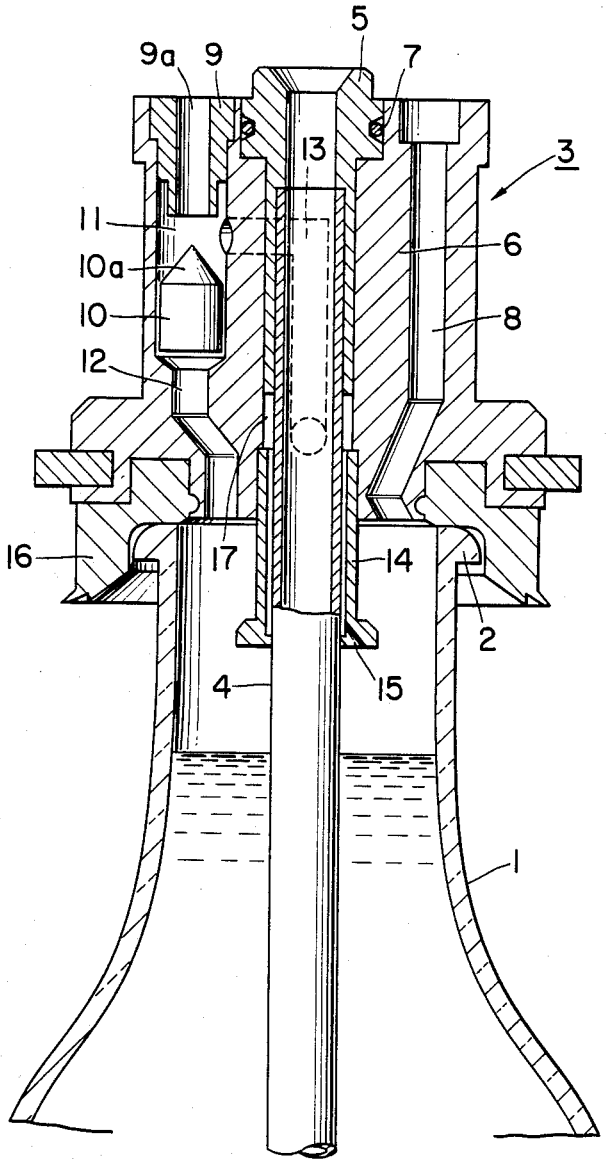
FIG. 1 is an elevational vertical section of a filling device in accordance with this invenion.

With reference to FIG. 1, a container or bottle 1 has a neck 2, over which is attached a counterpressure liquid filling device 3 having a liquid filling tube 4 for filling the desired liquid into the container 1. A top end sleeve 5 of the filling tube 4 is positioned in and supported by the filling element body 6 with an O-ring 7 encircling the end sleeve 5, and further is connected to a liquid tank (not shown). In the figure, to the right of the top end sleeve 5 is provided a pressurized gas supply conduit 8 for supplying pressurized gas into the container 1, which conduit opens into the neck 2 of the container 1.

On the other hand, to the left of the top end sleeve 5 is provided a gas discharge sleeve 9 which represents an exit of the gas discharge passage. A valve operating chamber 11 encasing a gas flow control valve 10 is provided below the gas discharge sleeve 9 and in communication therewith. The gas flow control valve 10 is made of a stainless steel and is formed with a conical-shaped upper half part 10*a* and a cylindrical-shaped bottom half part. The bottom end of the valve operating chamber 11 is communicated with a first branch discharge conduit 12 leading into the interior of the container 1, while the middle portion of the valve operating chamber 11 is communicated with a second branch discharge passage 13. The second branch discharge passage 13, meanwhile, is connected to a small space, designated by reference numeral 17, which is defined by the bottom end of the top end sleeve 5 and an upper end of a gas discharge tubular sleeve 14 encircling the filling tube 4, and being fixedly positioned within the filling element body 6. The bottom end of the gas discharge tubular sleeve 14 is positioned at a preselected location, by means of which the quantity of the liquid to be filled is adjusted. A gas discharge aperture 15 is provided at a portion of the bottom end of the tubular sleeve 14. The gas or air, which has made an entry through the gas discharge aperture 15, flows through a space between the outer wall of the filling tube 4 and the inner peripheral wall of the gas discharge tubular sleeve 14, enters the space 17, and further proceeds to the upper portion of the second branch discharge passage 13. To the bottom of the filling element body 6 is coupled a sealing rubber 16 which is expanded outwardly from the upper portion to the lower portion and is capped over the neck 2 of the container 1, keeping an air-tight engagement.

Now, in conjunction with FIGS. 1 and 2, the operation of the counterpressure liquid filling device of the present invention will be described.

When a liquid filling is initiated through the filling tube 4, carbon dioxide bubbles out of the carbonated beverage, such as beer and other refreshments. For the purpose of blocking the generation of such carbon dioxide, pressurized air is supplied through the pressurized gas supply conduit 8 from an unshown pressurized air source and enters the first branch discharge conduit 12 and the second branch discharge passage 13, and thereafter, the pressurized gas supply conduit 8 is closed.

The air within the container is discharged to the atmosphere through the first branch discharge conduit 12, the second branch discharge conduit 13, and finally the gas discharge sleeve 9. Since there is provided a narrow gap or clearance between the inner wall of the valve operating chamber 11 and the outer wall of the cylindrical bottom half of the gas flow control valve, which gap is substantially large enough to allow the valve to move upward and downward (about 0.03 to 0.07 mm), the air in the first branch discharge conduit 12 can flow through the gap and reach the gas discharge sleeve 9. At the same time, the air from the second branch discharge passage 13 also can flow into the upper portion of the gas flow control valve 10 of the valve operating chamber 11, whereupon the pressures of the first branch discharge conduit 12 and the second branch discharge conduit 13 are kept balanced or equalized. However, thanks to its own weight, the gas flow control valve 10 will rest at the lowermost position within the valve operating chamber 11.

Figure 2:
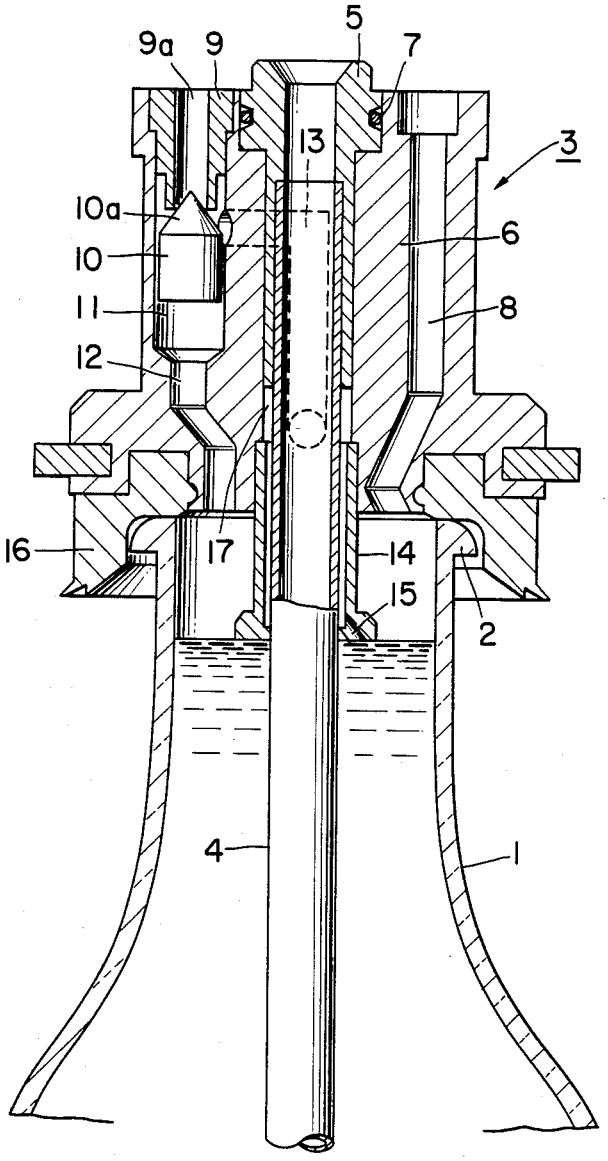
FIG. 2 is a view for a description of the operation of the counterpressure filling device shown in FIG. 1.

As the liquid surface level ascends, it reaches the bottom end of the gas discharge tubular sleeve 14 and, as shown in FIG. 2, seals the gas discharge aperture 15. When this occurs, the pressure within the first branch discharge conduit 12 is increased to a point where it is greater than those of the second branch discharge passage 13 and of the gas discharge sleeve 9. As a result, the gas flow control valve is moved upward, and its conical shaped upper half portion 10*a* seals the bottom end of the gas discharge passage 9*a* of the gas discharge sleeve 9.

Consequently, since there is left no exit for the air and the pressure within the container is increased, the ascent of the liquid surface level is brought to a halt, and the liquid supply is also terminated thereby.

It should here be pointed out that the clearance or gap between the outer lateral wall of the gas flow control valve 10 and the inner wall surface of the valve operating chamber 11 should be determined with ample technical considerations because, if the clearance is too large the valve 10 is not moved upward due to too much air escaping therefrom, and, if the clearance is too small, there is hardly any air escape therefrom, which becomes an obstruction not only to the liquid filling operation but also to the upward movement of the valve 10. Therefore, the determination of the magnitude of the clearance should be made by taking into consideration such factors as the air pressures and the weight of the gas flow control valve 10.

As has been described above, because of the fact that as soon as the second branch discharge passage 13 is sealed, the entire air discharge passage is closed and no liquid is permitted into the second branch discharge passage 13, it is not necessary to blow out or blast the second branch discharge passage 13.

It should now be apparent from the foregoing description that, in accordance with the current invention to be applied to the filling of carbonated beverages such as beer and other refreshments, it has become possible to entirely eliminate the blowout or blast process from the conventional liquid filling device. Also, since the invention makes use of the pressure differentials to actuate the valve, it can be applied easily to the conventional liquid filling devices. Further, the counterpressure filling device according to the current invention is extremely useful in connection with control over microorganisms and quite effective in reducing or eliminating loss or waste of the filling liquid, yet it is possible to precisely fill a selected quantity of the liquid into the container.

Industrial Applicability of the Invention

It should be apparent from the above description that the counterpressure liquid filling device according to this invention has utility in its application to the filling of liquids such as beer and other beverages, which are filled under applied pressure.

What is claimed is:

1. A liquid filling device comprising:

(a) a filling tube (4) for filling a liquid into a container;

(b) a pressurized gas supply conduit (8) for introducing pressurized gas into the container for bringing the container under elevated pressure;

(c) a gas discharge passage (9*a*) for discharging the pressurized gas into the atmosphere as the liquid surface level within the container moves upward, the gas discharge passage being branched into a first branch discharge conduit (12) and a second branch discharge passage (13), a bottom end of the first branch discharge conduit (12) being in communication with a neck of the container at a first position, a bottom end of the second branch discharge conduit (13) being in communication with the container at a second position below said the first position, at which second position the quantity of the liquid to be filled is determined, both upper end of the first branch discharge conduit (12) and the second branch discharge passage (13) being in communication with a valve operating chamber (11); and (d) a gas flow control valve (10) housed in the valve operating chamber (11) for opening or closing the gas discharge passage (9*a*) to permit or prohibit gas discharge into the environment, the gas flow control valve (10) being accommodated loosely in the valve operating chamber (11), wherein, said first branch discharge conduit (12) and said second branch discharge passage (13) are in communication with mutual opposite sides of the valve operating chamber (11) with respect to the gas flow control valve (10) before the liquid surface level reaches the second position in connection with the bottom end of said second branch discharge passage (13), and when the liquid surface has reached the second position and the bottom end of the second branch discharge passage (13) has been sealed thereby, the gas within the first branch discharge conduit (12) moves the gas flow control valve (10) upward, thereby sealing the gas discharge passage (9*a*).

2. A liquid filling device as set forth in claim 1 wherein the first branch discharge conduit (12) is communicated with the valve operating chamber (11) at the bottom end thereof, and the second branch discharge passage (13) is communicated with the valve operating chamber (11) at a location above the gas flow control valve (10) when said valve (10) is resting at the lowermost position thereof.

3. A liquid filling device as set forth in claim 1 wherein the gas flow control valve (10) comprises a conical upper half portion and a cylindrical bottom half portion.

4. A counterpressure liquid filling device as set forth in claim 1 wherein the gas flow control valve is formed of stainless steel.

* * * * *